US005241909A

United States Patent [19]

Eches et al.

[11] Patent Number: 5,241,909

[45] Date of Patent: Sep. 7, 1993

[54] CONTAINER EQUIPPED WITH ELECTRICAL CONNECTION MEANS

[75] Inventors: Nicolas Eches; Bernard Brion, both of Bourges; Michel Brule, Lury; René Laurensou, Bourges, all of France

[73] Assignee: GIAT Industries, France

[21] Appl. No.: 832,304

[22] Filed: Feb. 7, 1992

[30] Foreign Application Priority Data

Feb. 11, 1991 [FR] France ..... 91 01501

[51] Int. Cl.[5] ..... F42C 19/12

[52] U.S. Cl. ..... 102/202; 102/202.8; 102/202.9; 102/202.14; 102/472; 102/443

[58] Field of Search ..... 102/202.5, 202.7, 202.8, 102/202.9, 202.11, 202.13, 202.14, 470, 472, 275.11, 430, 443, 202

[56] References Cited

U.S. PATENT DOCUMENTS

| | | | |
|---|---|---|---|
| 777,319 | 12/1904 | Ulrich | 102/430 |
| 2,743,580 | 5/1956 | Loeb, Jr. | 102/202 |
| 3,136,872 | 6/1964 | Banaszak | 102/202 |
| 3,299,812 | 1/1967 | Suh et al. | 102/202.5 |
| 3,759,183 | 9/1973 | Apstein | 102/202.5 |
| 3,952,658 | 4/1976 | Broyles | 102/438 |
| 4,616,565 | 10/1986 | Reinovsky | 102/202.7 |

FOREIGN PATENT DOCUMENTS

| | | | |
|---|---|---|---|
| 0124183 | 11/1984 | European Pat. Off. . | |
| 0314547 | 5/1989 | European Pat. Off. . | |
| 552266 | 8/1958 | Italy | 102/472 |
| 332143 | 10/1958 | Switzerland | 102/443 |
| 500052 | 1/1971 | Switzerland . | |
| 729372 | 5/1955 | United Kingdom | 102/472 |
| 2136929 | 9/1984 | United Kingdom . | |

*Primary Examiner*—Stephen M. Johnson
*Attorney, Agent, or Firm*—Parkhurst, Wendel & Rossi

[57] ABSTRACT

The invention relates to modular containers for propellant charges. The container includes a container casing which partially defines an inner volume for a propellant charge. The container 1*a* of the invention that shall be rigidly assembled to another container 1*b* at one of its end surfaces and is characterized in that it comprises electrical connection means ensuring at least one electrical connection to the second container.

14 Claims, 5 Drawing Sheets

CONTAINER EQUIPPED WITH ELECTRICAL CONNECTION MEANS

BACKGROUND OF THE INVENTION

The present invention concerns containers for a propellant charge and more particularly containers used for large-caliber rounds or tank artillery.

In order to adjust firing range, it is frequently necessary to alter the amount of powder used to launch a projectile.

Substantially cylindrical and modular containers made of a combustible material are known. Because of their rigidity, such containers are more usable than the conventional powder bags.

In order to reduce the space taken up by the ammunition inside armored vehicles, it may furthermore be necessary to divide a container into two distinct parts, namely one part holding the main propellant charge and the other the projectile. Also, a secondary charge may be desirable (e.g., British patent 2,136,929).

In the case of including two containers, each holding a propellant charge, there is a problem of igniting these charges. In order to achieve homogeneous ignition and consistent inner-ballistic properties, the charge must be lit substantially instantaneously over its entire length. In the state of the art, ignition tubes are used (e.g., French patent document 7,606,456 for cartridge-ammunition). However, such ammunition cannot be used where charges are present in separate containers.

The patent document WO 8,601,584 proposes a combustible container comprising an axial duct bounded by annular compacted ignition materials. Following stacking of several containers, the axial duct therefore assumes acts as an ignition tube for the entire charge. A single igniter at one end of the duct ensures instantaneous ignition of all annular compacted materials.

Nevertheless, such a design fails to ensure instantaneous ignition of the entire charge for long (e.g., more than five-fold the caliber) charges. Propellant pressure may be non-uniform and ballistic performance is mediocre and fairly inconsistent.

Further, when a container houses a projectile and not a propellant charge, it may be necessary to provide electrical connection between the weapon and the projectile. Illustratively, this may be the case when programming a fuze including a projectile or when charging a capacitor included with this projectile.

A first object of the invention is to propose a container which shall be rigidly affixed to another container and which comprises means for at least one electrical connection to the second container.

Another object of the invention is to provide a container comprising means ensuring instantaneous ignition of the entire propellant charge following assembly of the containers.

SUMMARY OF THE INVENTION

Accordingly, the objects of the invention are achieved with a container, in particular to receive a propellant charge, which shall be rigidly affixed to another container at one of its end faces and which is characterized in that it comprises means for at least one electrical connection with the second container.

As a result, electrical connection is easily established between the weapon and the projectile and a signal to be fed to the projectile can be transmitted to a container near the weapon's breech.

In the event the container shall receive a propellant charge in at least two loads and comprises an electrically initiated igniter, the electrical connecting means links this igniter to a second igniter corresponding to the second container, the means ensuring simultaneous triggering of the two igniters.

Such a design allows instantaneous ignition of the entirety of the propellant charge.

In a particular embodiment of the invention, the container comprises at least one flame-transmitting device extending axially over substantially its entire length, and a relay charge in contact with the igniter. In particular embodiments, the electrical connecting means may comprise a conductor affixed to the flame transmitter, or a conductor affixed to the container casing. Advantageously, this conductor shall consist of at least one bonded metal strip. In a manner of variation, the electric connecting means entails metallizing the inside wall of the container casing or metallizing the wall of the flame transmitter.

In a particular embodiment, the electrical connecting means comprises a conducting surface affixed to the end face. When the end face is defined by a cover, the connecting means may comprise a conductive portion of at least a side surface of the cover.

In a particularly preferred embodiment, the electrical connecting means comprises a linkage ring also designed to ensure the mechanical linkage with the second container.

The container of the invention may be in the form of a bottom container or the projectile-bearing container of a two-load propellant charge, in which case it may include a constricted portion to be covered at least in part by the linkage ring. The constricted portion may include a conductive surface where it is covered by the ring.

Advantageously, the conductive surface near the constricted portion shall be in the form of at least one contact clamped between the container casing and a closing cover.

The invention is further described by the following description of particular embodiments and in relation to the enclosed drawings.

DESCRIPTION OF THE PREFERRED EMBODIMENTS

Figure 1:
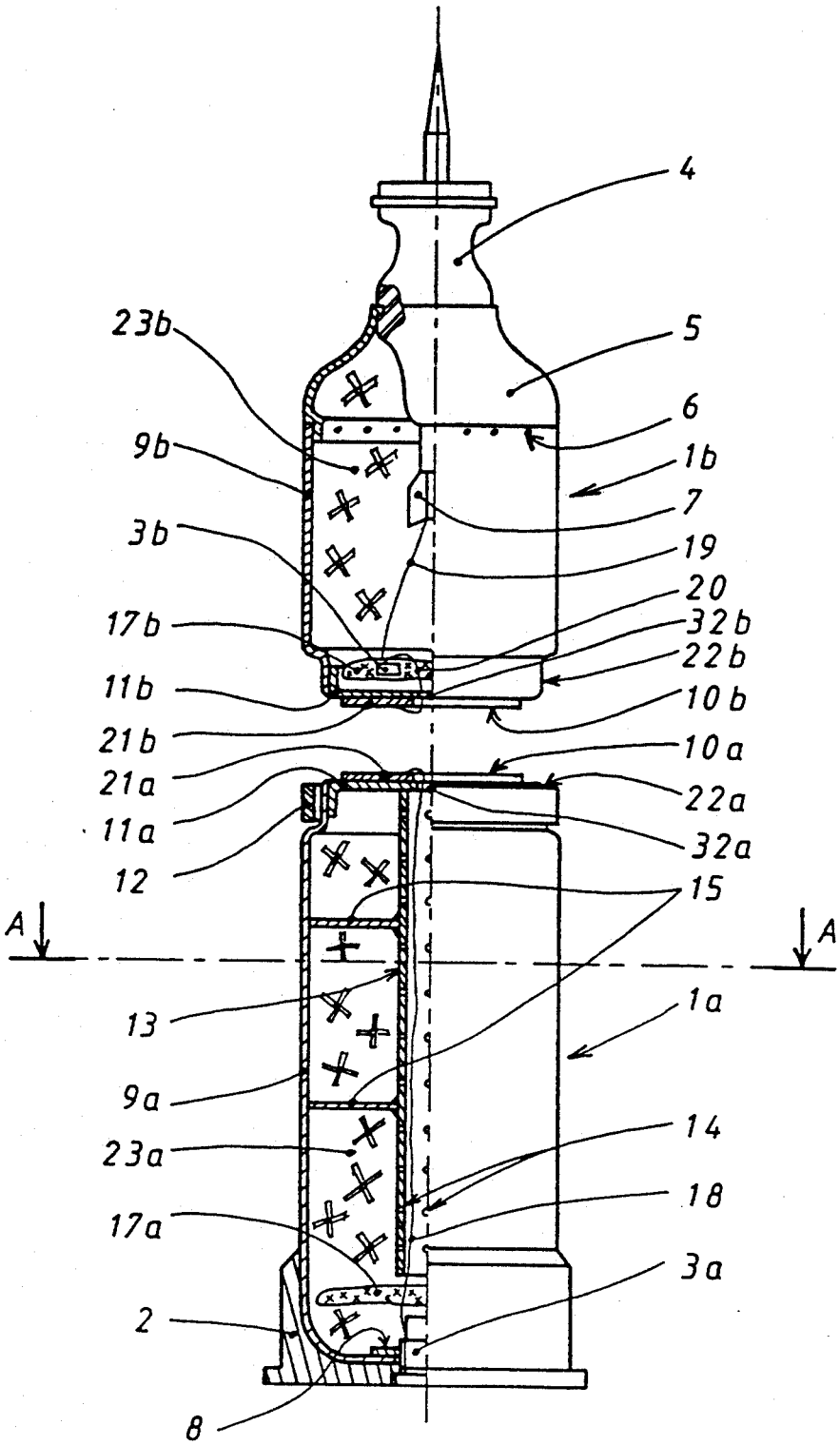
FIG. 1 is a half-section of ammunition consisting of two containers of the invention which shall be joined together.

FIG. 1 shows ammunition for armored vehicles and comprising a charge with two containers 1*a*, 1*b*.

The bottom container 1a bears a base 2 which is generally metallic and an igniter 3a which is initiated electrically and which is affixed to the base.

The casing 9a of this first container is made of a combustible material such as nitrocellulose or of cardboard and is rigidly affixed to the base 2 using an affixing washer 8 (any other suitable fastening means also may be used), and it is closed at its other end by a cover 11a also made of a combustible material.

At its end opposite to its base, the casing includes a constricted portion 22a receiving a ring 12 of which the function shall be discussed further below.

The projectile-bearing container 1b also comprises a casing 9b made of a combustible material. Casing 9b is closed by a cover 11b and supports a projectile 4 (in this case an arrowhead projectile) by means of a plastic, for instance polyamide link 5.

Link 5 is manufactured by injection-molding at the projectile body in the vicinity of an annular groove and link 5 is affixed by rivets 6 to the casing 9b (the rivets may be replaced by bonding if desired).

The casing 9b also includes a constricted portion 22b.

The two containers contact each other at their end faces 10a, 10b. The ring 12 ensures proper axial and relative positioning of the two containers and also allows fixing in place the two charge portions.

For that purpose, ring 12 is slidable on the constriction 22b and may straddle constricted portions 22a and 22b. Next, the ring is fixed in place in this position by using adhesive paper, for example.

It is also suitable in this invention to provide a ring 12 having an inside diameter which is slightly less than that of constricted portions 22a, 22b, thereby providing linkage following the localized deformation of the container casings 9a and 9b.

The container 1a also includes a flame-transmitting device embodied as a combustible duct 13 which is substantially coaxial with the casing 9a. Duct 13 is kept in position by two combustible spacers 15 resting against the inner surface of the casing 9a.

Figure 2:
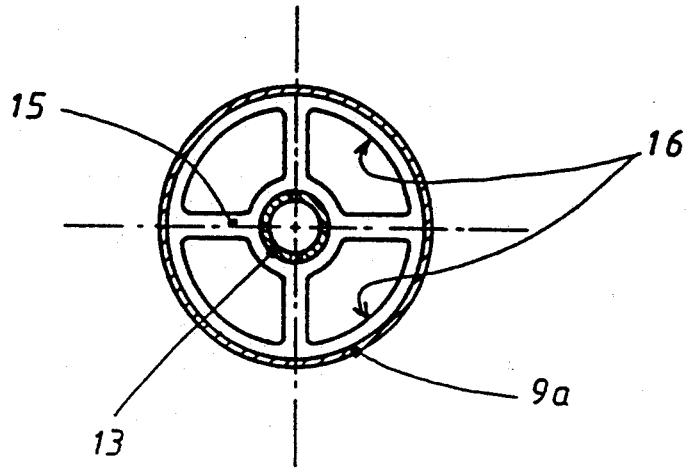
FIG. 2 is a section of the FIG. 1 along the plane A—A.

Preferably spacers 15 shall be bonded to duct 13; moreover, spacers 15 comprise regularly arrayed apertures 16 (FIG. 2) for filling granular propellant charge 23a inside the container.

Duct 13 is perforated with holes 14 to ignite the propellant charge 23a.

A relay charge 17a consisting of a black-powder filled pouch and substantially covering the entire cross-section of container 1a is located near the igniter. Relay charge 17a ensures ignition of propellant charge 23a uniformly over a plane substantially normal to the igniter axis. Duct 13 acts as the ignition tube for propellant charge 23a.

The flame generated from the relay charge 17a propagates inside the tube and ignites the main charge 23a through the holes 14. An electrical wire 18 covered by an insulating sheath connects the igniter 3a with a conductive surface 21a deposited on the cover 11a at the end face 10a. Wire 18 passes inside the duct 13, its stripped end being affixed to the conductive surface by an adhesive sheet (illustratively self-sticking aluminum foil). Alternatively, metallized surfaces 30a (FIG. 4) may be employed.

Container 1b also contains a relay charge 17b which is in the form of a black-powder pouch substantially covering the cross-section of container 1b.

A second electric igniter 3b of a known design is present inside relay charge 17b and is linked by a ground wire 19 to the projectile 4 (in this instance by means of the stabilizer 7 to which it is brazed, or bonded by a self-sticking aluminum foil) and by a connection wire 20 to a conductive surface 21b deposited on the cover 11b at the end face 10b. The stripped end of the wire 20 also shall be affixed by a self-sticking conducting sheet.

Conductive surfaces 21a and 21b are preferably annular and encircle axial openings 32a and 32b in covers 11a and 11b, respectively. Axial openings 32a, 32b (which are sealed by sheets of paper) allow for propagating of the flame from the igniter 3a to complete the ignition of the relay charge 17b.

Advantageously, the wires 18 and 20 shall be made to pass through the apertures 32a and 32b.

When the two containers are affixed to each other, the conductive surfaces 21a and 21b make contact with each other, whereby an electrical circuit is set up which connects the two igniters 3a and 3b and which allows simultaneously triggering these two igniters.

The propellant charge 23b may be in the form of grains, but preferably it shall be in the form of hollow fibers. Such a charge ensures quick propagation of the flame.

Duct 13 may be replaced by another flame-transmitting device such as a black-powder ignition tube or a detonator-cord ignition tube (e.g., French patents documents 7,606,456 and 8,113,079). In any case, wire 18 shall be affixed to the device by bonding it onto the outer surface of that device, for bonding it onto the outer surface of that device, for example.

The containers are assembled as follows:

With respect to container 1a, casing 9a is rigidly affixed to the base 2 to which is also affixed the wire 18. Granular powder is present at the bottom of the base to ensure maximum filling, then the relay-charge 17a is put in place. Duct 13 equipped with its spacers 15 is placed inside the casing, wire 18 extending inside the duct. The casing 9a is filled with the propellant charge 23a through the spacer apertures 16. The assembly is vibrated to ensure optimal filling. Cover 11a is put in place and the wire 18 is connected to the conductive surface 21a.

With respect to container 1b, first the casing 9b is connected by rivets 6 to the projectile. The powder, the ground wire 19 and the relay-charge 17b are put in place. Cover 11b is put in place and the wire 20 is connected to the conductive surface 21b.

Figure 3:
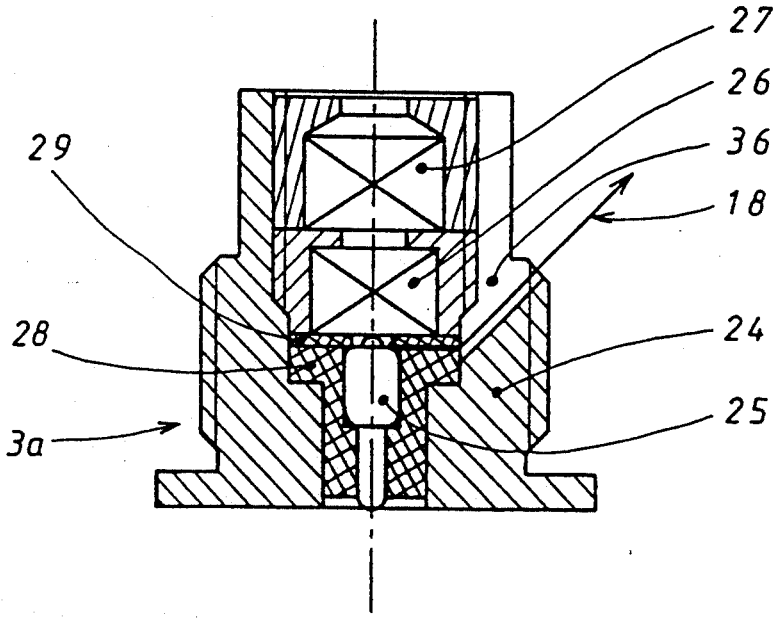
FIG. 3 is a schematic of an igniter adapted to a container of the invention.

FIG. 3 shows the igniter 3a. It comprises a conductive body 24 that is screwed into the base 2. A squib box 26 containing a squib is screwed into an axial housing of the body 24. A second box 27 containing a flame-reinforcing composition is screwed into the body housing and makes contact with the squib box 26. An insulating plastic support 28 closes the axial housing of the body 24 and receives a conductive pin 25 making electrical contact by one of its ends with one of the contacts of the squib box 26. An insulating washer 29 is clamped between the insulating support 28 and the squib box 26. The connecting wire 18 includes a stripped end which is clamped between the insulating washer 29 and the pin 25. Wire 18 passes out of the body 24 though a radial clearance 36. When the assembled containers are put in place in the weapon chamber, squib box 26 will be connected to the weapon ground through the body 24 and the base 2. The igniter 3b is connected to the weapon ground by means of the projectile 4.

Upon command to fire, pin 25 is fed a voltage which is transmitted to the squib box 26 and to the igniter 3b through electrical connecting means which, in this particular embodiment, includes connection wires 18, conductive surfaces 21a and 21b of the covers and connection wire 20.

Accordingly, the two igniters are initiated simultaneously and simultaneous ignition of the charges in the two containers is ensured as well as uniform pressure in the weapon chamber.

Figure 4:
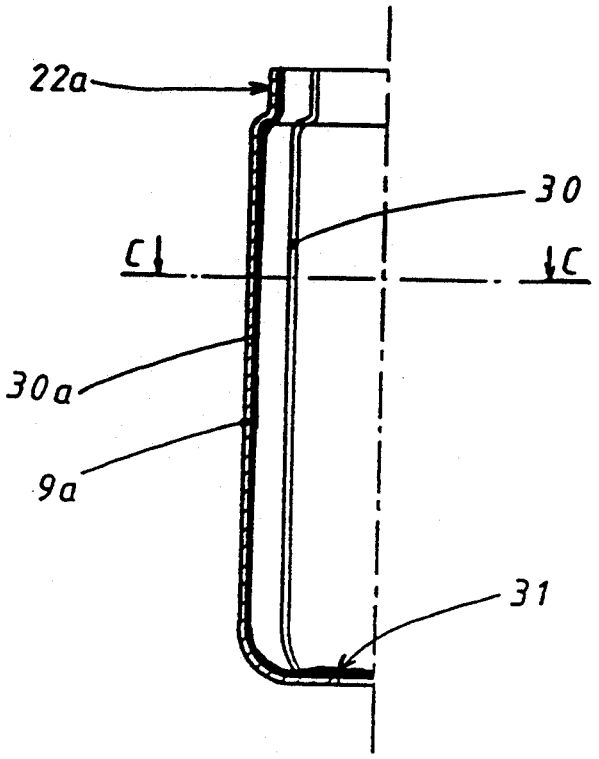
FIGS. 4 and 5 show only the casing of the container for a particular embodiment of the invention, FIG. 5 being the half-section of FIG. 3 along the plane B—B and FIG. 4 being the section of FIG. 5 along the plane C—C.
Figure 5:
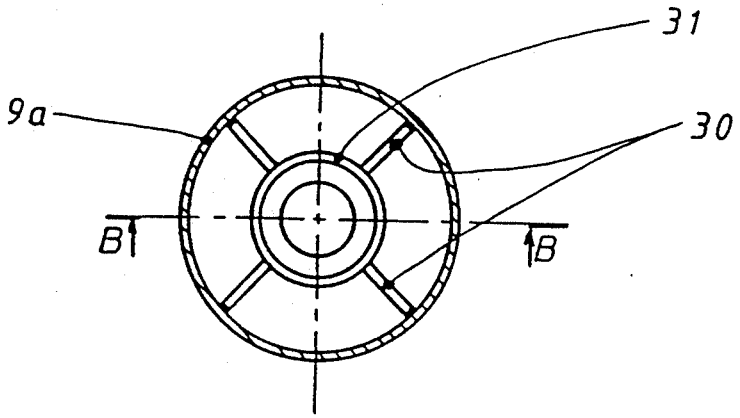

The electrical connecting means may assume other embodiments:

Illustratively and as shown by FIGS. 4 and 5, one embodiment calls for replacing the connection wire 18 with conductive strips 30 arranged on the inner surface of the casing 9a of the container 1a. In this case, there are four angularly equidistant strips; they are made for instance by bonding aluminum foils. Strips 30 are electrically connected to each other by a circular strip 31 also made of a bonded aluminum foil and present at the bottom of the casing 9a.

The igniter 3a is connected by a wire (not shown) to the circular strip for instance by means of adhesive conductive paper, the diameter of the circular strip 31 therefore being larger than the diameter of the washer 8 affixing the casing 9a to the base 2.

In this case, the strips 30 may be advantageously extended on the casing outer surface as far as constricted portion 22a. Also, the entire inner surface of the casing 9a may also be metallized.

Figure 6:
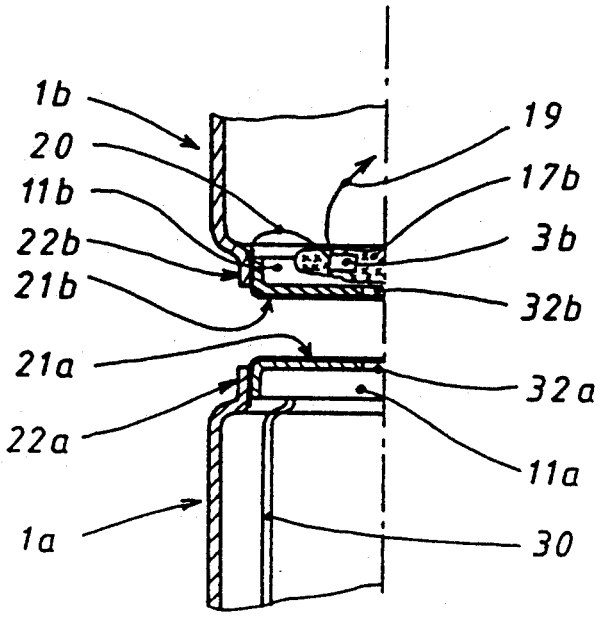
FIGS. 6, 7 and 8 are partial views of different embodiments of the invention.
Figure 7:
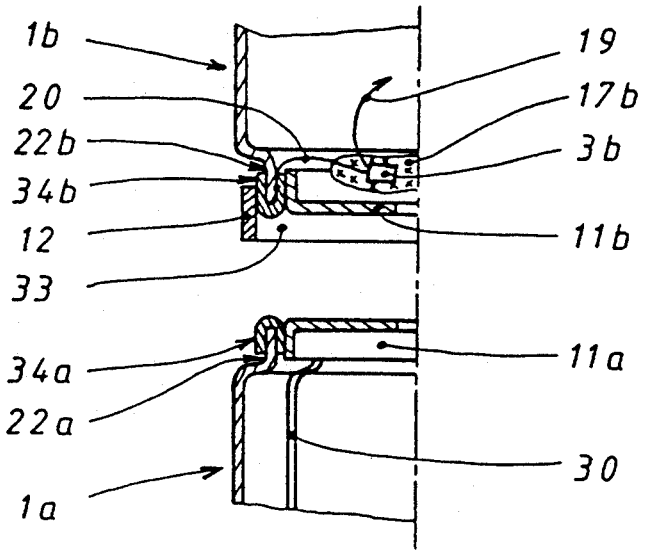

In relation to FIGS. 6 and 7, the means for electrically connecting the strips so described and the container 1b shall be elucidated.

In the embodiment partly shown by FIG. 6, the covers 11a and 11b evince substantially annular conductive surfaces 21a and 21b for the purpose of making mutual contact. These conductive surfaces extend on at least part of the side surface of the covers in such a manner that they make contact with the strips 30 (cover 11a) and to clamp the stripped end of the connection wire 20 (cover 11b). Within the scope of this particular embodiment, the strips 30 may be replaced by a connection wire 18 clamped between the cover 11a and the casing 9a. Again, a container 9a might be used of which the entire inner surface is metallized.

With respect to the embodiment partly shown by FIG. 7, the covers 11a and 11b are entirely insulating.

One or more conductive contacts 34a, 34b —for instance folded aluminum foils —are present at the constricted portions 22a and 22b.

Contacts 34a, 34b are positioned in such a way that they make electrical contact with the strips 30 (contacts 34a) and clamp the stripped end of the connection wire (contacts 34b). The connection ring 12 includes an inner conductive surface 33 and assures therefore the electrical connection between the contacts 34a and the contacts 34b following assembly of containers 1a and 1b.

Within the scope of this particular embodiment, one may also metallize part of the inner surface of the cover 11b as well as its periphery making contact with the contacts 34b. In such a case, the connection wire 20 would be connected by an adhesive conductive paper to the metallized cover.

Advantageously, the inner metallization of the cover may be implemented by self-sticking conducting strips extending radially from the inside surface of the cover 11b as far as its peripheral surface is in contact with the contacts. It may be required in some cases to connect the ground wire 19 of the igniter to the weapon ground by means of the base 2.

Figure 8:
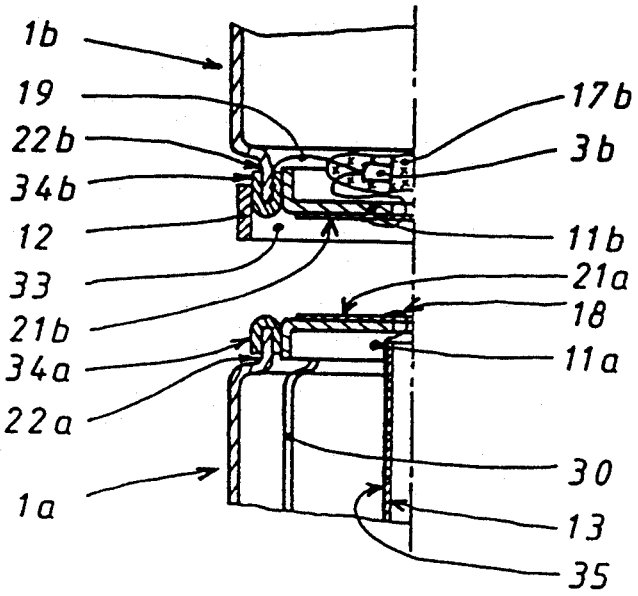

FIG. 8 is a variation of the containers of the invention adapted to this case.

In this embodiment, the container of the present invention comprises strips 30 arranged on the inner surface of the casing 9a. Strips 30 are electrically connected to the base 2, illustratively by contact between the circular strip 31 and the affixing washer 8.

Contacts 34a also are present at the constricted portions 22a in the same manner as in the previous embodiment.

Moreover, the container also comprises a duct 13 of which the outer surface 35 is metallized.

A first connection wire (not shown) links the surface 35 to the igniter 3a and a second connection wire 18 links this surface 35 to the annular conductive surface 21a of the cover 11a. Advantageously the wire 18 passes through the axial opening 32a.

The container 1b bears contacts 34b clamping the ground wire 19, the connection wire 20 being linked to the annular conductive surface 21b through the axial opening 32b. The ring 12 comprises a conductive inner surface 33 and ensures the electrical connection between the contacts 34a and the contacts 34b.

In this particular embodiment, the electrical connection means includes a ground circuit including strips 30, contacts 34a and 34b, ring 12 and the ground wire 19; a supply circuit including a first connection wire, the metallized surface 35, the second connection wire 18, the cover contact surfaces 21a and 21b and the connection wire 20.

As explained above, the ground wire 19 might be replaced here by conductive strips disposed on the inside surface of the cover 11b. Again, the inner surface of the container might be metallized.

Lastly, the container of the invention also may be a modular container which shall be rigidly assembled to two other containers so as to achieve an artillery charge of a specified power. Modular containers already are known, in particular from WO 8,601,584. Within the scope of such a field of application, the invention would allow instantaneous ignition of the entire charge regardless of the number of stacked containers.

All the above described embodiments relate to containers filled with a propellant charge and in all cases the electrical connection means serve to connect two igniters.

The above described connection means also may be used to link the fuze of an explosive projectile to the bottom container's base. In this case, the base shall be adapted to receive contact terminals through which an electrical signal to the projectile shall be transmitted.

These terminals shall be linked to the above-described connection means (e.g., strips, metallization, covers, contacts) by flexible wires and by adhesive, conductive tape.

Moreover, the projectile-bearing container, whether receiving a propellant charge or not, shall comprise the above-described connection means (e.g., covers, contacts, strips, metallization) which are linked by flexible wires to the projectile body, for instance to the base or to the stabilizer(s).

We claim:

1. A container assembly containing a propellant charge for propelling a projectile, comprising:

a first container for housing a first portion of said propellant charge, said first container comprising a casing closed off at a first end thereof by a top cover, and an igniter for igniting said first portion of said propellant charge;

a second container for housing a second portion of said propellant charge, said second container comprising a casing closed off at a first end thereof by a bottom cover, and an igniter for igniting said second portion of said propellant charge; and electrical connection means for electrically connecting said first and second igniters to each other to initiate said first and second igniters simultaneously, said electrical connection means comprising:

a first conductor electrically connecting said first igniter to an electrically conductive top surface on said top cover of said first container; and a second conductor electrically connecting said second igniter to an electrically conductive bottom surface on said bottom cover of said second container, wherein said first and second containers are adapted to be assembled together such that said conductive top and bottom surfaces are in contact with each other.

2. The container assembly of claim 1, wherein said first igniter comprises an ignition casing which houses an ignition charge.

3. The container assembly of claim 2, wherein said ignition casing is electrically conductive.

4. The container assembly of claim 1, wherein said first container further comprises a flame-transmitting device extending axially along substantially the entire length of said first container, and a relay charge for generating a flame for propagation through said flame-transmitting device.

5. The container assembly of claim 4, wherein said first conductor is attached to said flame-transmitting device.

6. The container assembly of claim 5, wherein said first conductor is wire.

7. The container assembly of claim 5, wherein said first conductor comprises at least one metal strip.

8. The container assembly of claim 1, wherein said first conductor comprises at least one metal strip disposed along the casing of the first container.

9. The container assembly of claim 1, wherein said first conductor is defined by a metallized inner wall of the casing of said first container.

10. The container assembly of claim 1, wherein said first conductor is a wire.

11. The container assembly of claim 1, further comprising a movable ring for mechanically and electrically connecting said first and second containers to each other.

12. The container assembly of claim 1, wherein said casing of said first container is combustible.

13. The container assembly of claim 1, wherein said first container further comprises a base rigidly affixed to the casing of the first container at a second end thereof, said first igniter positioned adjacent said base.

14. The container assembly of claim 1, wherein said second container further comprises a projectile disposed opposite the first end of the casing of the second container, wherein said second igniter is positioned adjacent said bottom cover.

* * * * *